US008967294B2

(12) United States Patent
Rozenblit et al.

(10) Patent No.: US 8,967,294 B2
(45) Date of Patent: Mar. 3, 2015

(54) RECHARGEABLE BATTERY CONTROLLER

(75) Inventors: Vladimir Rozenblit, Houston, TX (US); Vadim Buryakovsky, Houston, TX (US); Andre Etienne Orban, Sugarland, TX (US); Daniel Maurice Lerner, Missouri City, TX (US); Charles Ian McAndrew, Magnolia, TX (US); Mariusz Thomas Zientarski, Edmonton (CA)

(73) Assignee: R&B Industrial Supply Company, Houston, TX (US)

( * ) Notice: Subject to any disclaimer, the term of this patent is extended or adjusted under 35 U.S.C. 154(b) by 690 days.

(21) Appl. No.: 13/195,224

(22) Filed: Aug. 1, 2011

(65) Prior Publication Data

US 2013/0032403 A1 Feb. 7, 2013

(51) Int. Cl.
*E21B 47/12* (2012.01)
*E21B 41/00* (2006.01)

(52) U.S. Cl.
CPC ..... *E21B 47/12* (2013.01); *E21B 41/0085* (2013.01)
USPC ..... 175/40; 166/65.1

(58) Field of Classification Search
USPC ..... 175/40, 24; 166/65.1; 340/854.4
See application file for complete search history.

(56) References Cited

U.S. PATENT DOCUMENTS

| | | | | |
|---|---|---|---|---|
| 6,026,915 | A * | 2/2000 | Smith et al. | 175/50 |
| 2008/0245570 | A1* | 10/2008 | Partouche | 175/48 |
| 2012/0090827 | A1* | 4/2012 | Sugiura | 166/65.1 |
| 2013/0032403 | A1* | 2/2013 | Rozenblit et al. | 175/40 |
| 2013/0341092 | A1* | 12/2013 | Hay et al. | 175/24 |
| 2014/0083771 | A1* | 3/2014 | Clark | 175/40 |

* cited by examiner

*Primary Examiner* — Daniel P Stephenson
(74) *Attorney, Agent, or Firm* — Oren Reches

(57) ABSTRACT

A method and a system may be provided. The system may include: a drilling pipe that comprises an inner space; a telemetry system, arranged to (a) sense drilling information about an underground drilling process that is executed by the system, and (b) transmit the drilling information to an entity that is located outside the drilling pipe; a rechargeable battery arranged to provide power to at least one telemetry module of the telemetry system; and a controller, arranged to control a provision of power to the at least one telemetry module and to control a charging of the rechargeable battery. Wherein the at least one telemetry module, the rechargeable battery and the controller are shaped and sized to be positioned within the inner space of the drilling pipe. The battery and controller can also be mounted in the drilling collar.

9 Claims, 6 Drawing Sheets

RECHARGEABLE BATTERY CONTROLLER

BACKGROUND OF THE INVENTION

The present invention relates to a drilling system and method for use in gas and oil wells. During the drilling process various types of information are transmitted, by a telemetry system, from one or more sensors that may be proximate to a drilling bit and towards receivers that may be located within a drilling pipe and even on the surface.

The various types of information that should be transmitted by the telemetry system may include bit location, bit orientation, pressure and temperature of the borehole and characteristics of the geological formations.

In some drilling systems the telemetry system is located above a drilling motor, at about 15-30 meters behind the bit, depending on the Bottom Hole Assembly (BHA) composition.

The common methods of powering the telemetry systems in the drilling applications are: (a) primary battery such as, lithium cells or alkaline cells, or (B) using an electrical generator that uses the drilling fluid to provide the force to turn the turbine.

Both of the methods have significant drawbacks. The primary batteries are expensive and hazardous. The disposal of these batteries is a major concern, both in economic sense and because of the impact on the environment by the toxic waste.

The electrical generator often fails due the friction of the moving parts, and does not provide as much power as battery can, especially in small diameter drilling applications.

Also, in some drilling situations (under-balanced drilling) it is not even possible to use the generator. Using a generator can be difficult and even impractical during tripping in the borehole or out of the borehole.

SUMMARY OF THE INVENTION

In accordance with a preferred embodiment of the present invention, a system is provided. The system may include a drilling pipe that comprises an inner space; a telemetry system, arranged to (a) sense drilling information about an underground drilling process that is executed by the system, and (b) transmit the drilling information to an entity that is located outside the drilling pipe; a rechargeable battery arranged to provide power to at least one telemetry module of the telemetry system; and a controller, arranged to control a provision of power to the at least one telemetry module and to control a charging of the rechargeable battery. The at least one telemetry module, the rechargeable battery and the controller are shaped and sized to be positioned within the inner space of the drilling pipe or mounted in the drilling collar.

The system may include a battery identification module that is arranged to store rechargeable battery information, the rechargeable battery information may include rechargeable battery identification information and at least zero information items out of a manufacturing date of the rechargeable battery, an expiration date of the rechargeable battery, allowed temperature of the rechargeable battery.

The controller may be arranged to retrieve rechargeable battery information from the battery identification module and may be arranged to control at least one operational parameter of the rechargeable battery in response to the rechargeable battery information.

The system may include multiple rechargeable power modules, each rechargeable power module comprises a rechargeable battery and a controller.

According to an embodiment of the invention a method is provided and may include: performing an underground drilling process, by a system that comprises a drilling pipe, wherein the drilling pipe comprises an inner space; sensing, by a telemetry system, drilling information about the underground drilling process; transmitting, by the telemetry system, the drilling information to an entity that is located outside the drilling pipe; providing power, by a rechargeable battery, to at least one telemetry module of the telemetry system, during the underground drilling process; controlling, by a controller, a provision of power to the at least one telemetry module and to control a charging of the rechargeable battery; wherein the at least one telemetry module, the rechargeable battery and the controller are shaped and sized to be positioned within the inner space of the drilling pipe.

The method may include storing, by a battery identification module, rechargeable battery information, the rechargeable battery information comprises rechargeable battery identification information and at least zero information items out of a manufacturing date of the rechargeable battery, an expiration date of the rechargeable battery, allowed temperature of the rechargeable battery The method may include retrieving, by the controller, rechargeable battery information from the battery identification module and to controlling at least one operational parameter of the rechargeable battery in response to the rechargeable battery information.

The method can be executed by a system that has any of the mentioned above features.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

DETAILED DESCRIPTION OF A PREFERRED EMBODIMENT

Figure 1:
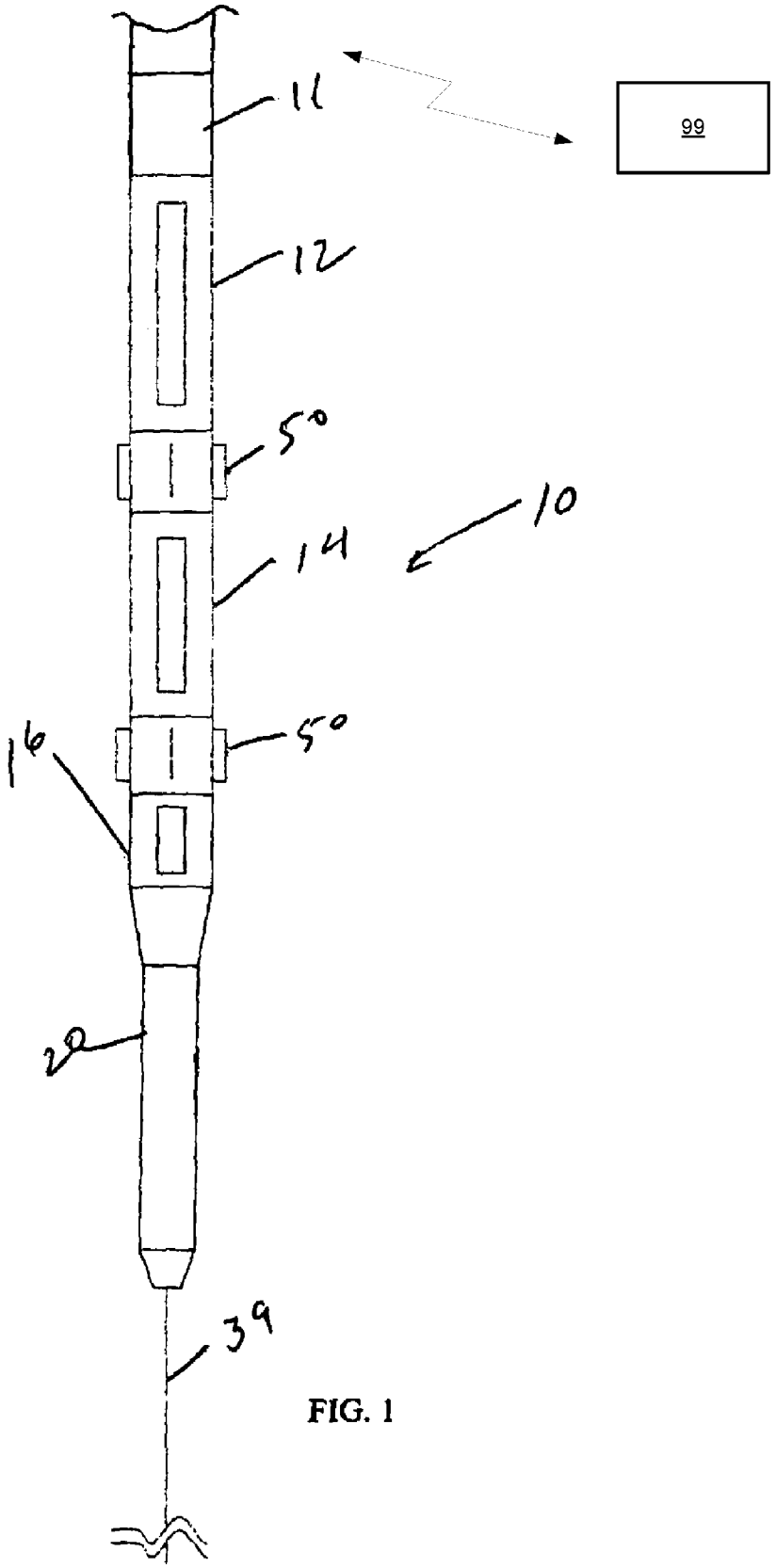
FIG. 1 is a schematic diagram showing the uphole assembly of the electric dipole transmission system of the present invention.

According to an embodiment of the invention a rechargeable power module is provided. The rechargeable power module includes one or more rechargeable batteries and a controller for optimizing the supply of power by the one or more rechargeable batteries.

The rechargeable power module may power one or more telemetry modules of a telemetry system of a drilling system. Non-limiting examples of telemetry modules may include a sensor, a receiver and a transmitter.

Different telemetry modules can interact with each other (for example by exchanging drilling information) and may exchange drilling information with an auxiliary unit that may be proximate to the telemetry system or be distant from the telemetry system. The auxiliary unit can be a processor, a memory unit, a receiver, a transmitter and the like.

The storage capacity (Ampere Hours) of the rechargeable power module as well as the voltage level supplied by the rechargeable power module can be determined based on the expected requirements of the telemetry system. For example, the rechargeable power module should be expected to be recharged one per one or more drilling shifts, each may last one or multiple hours.

Also, when the rechargeable battery is finally disposed of the composition is not as hazardous as in case of the primary battery.

According to an embodiment of the invention the rechargeable battery can be made out of NiMH or LiFePO4 or can include any other available rechargeable chemistry cells. The relative length of the battery can be about ⅓ of the length of the whole tool, or multiple of the batteries can make this contribution longer.

According to an embodiment of the invention the one or more rechargeable batteries may require a controller that may control the charging and, additionally or alternatively, the discharging of the rechargeable battery.

The controller can be arranged to optimize the performance of the rechargeable battery and may be configured to maximize the efficiency, safely and additionally or alternatively, the productivity of the rechargeable battery over extended period of time.

According to an embodiment of the invention the rechargeable battery can be associated with battery identification module that may store battery information such as but not limited to battery identification information, The battery information can include, for example, a battery identifier, a production date of the battery, an expiration date of the battery, information related to the materials from which the battery is made of, desired ambient temperature range and desired ambient humidity range.

According to an embodiment of the invention the controller may be arranged to perform at least one of the following:

a. Regulate the power flow out of the rechargeable battery.
b. Regulate the power flow into the rechargeable battery. The recharging can be dependent on borehole conditions. For example, the system can include a sensor that may sense borehole temperature and if the temperature is outside an allowable temperature range (for example—too high) then the recharging can be prevented.
c. Detecting the end of cycle of the rechargeable battery and switch the rechargeable battery off.
d. Collect battery information about the rechargeable battery usage conditions, including logging of current, voltage, vibration, temperature, etc.
e. Prevent using a rechargeable battery after its expiration date or when a predefined operational condition is not fulfilled.
f. Provide a cross over from the battery to any MWD system.
g. Keep track of used power and records the performance data, such as current flow, voltage levels, vibrations, temperature, etc.
h. Make the system secure—as the release of power is controlled by a password or a special key.
i. Shut off the power when programmed to do so under certain conditions such as loss of drilling fluid flow.

Figure 4:
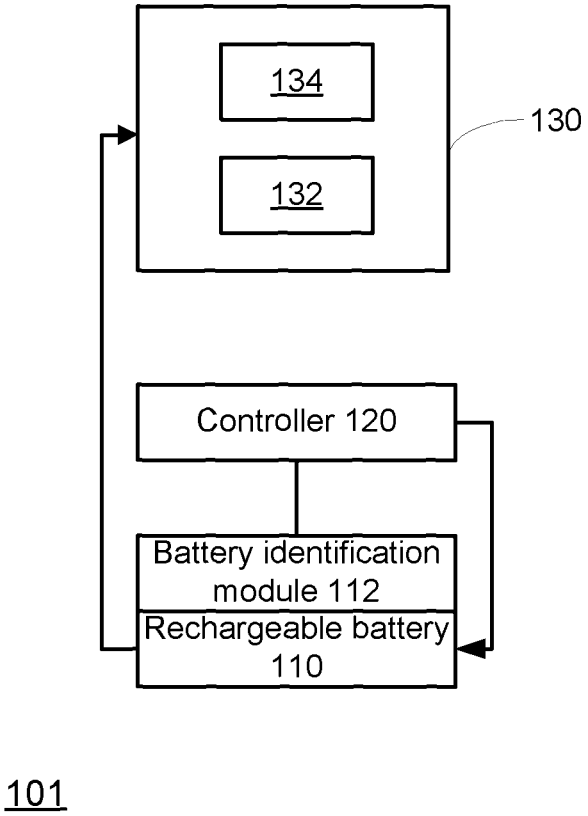
FIG. 4 illustrates a portion of a drilling system according to an embodiment of the invention.
Figure 5:
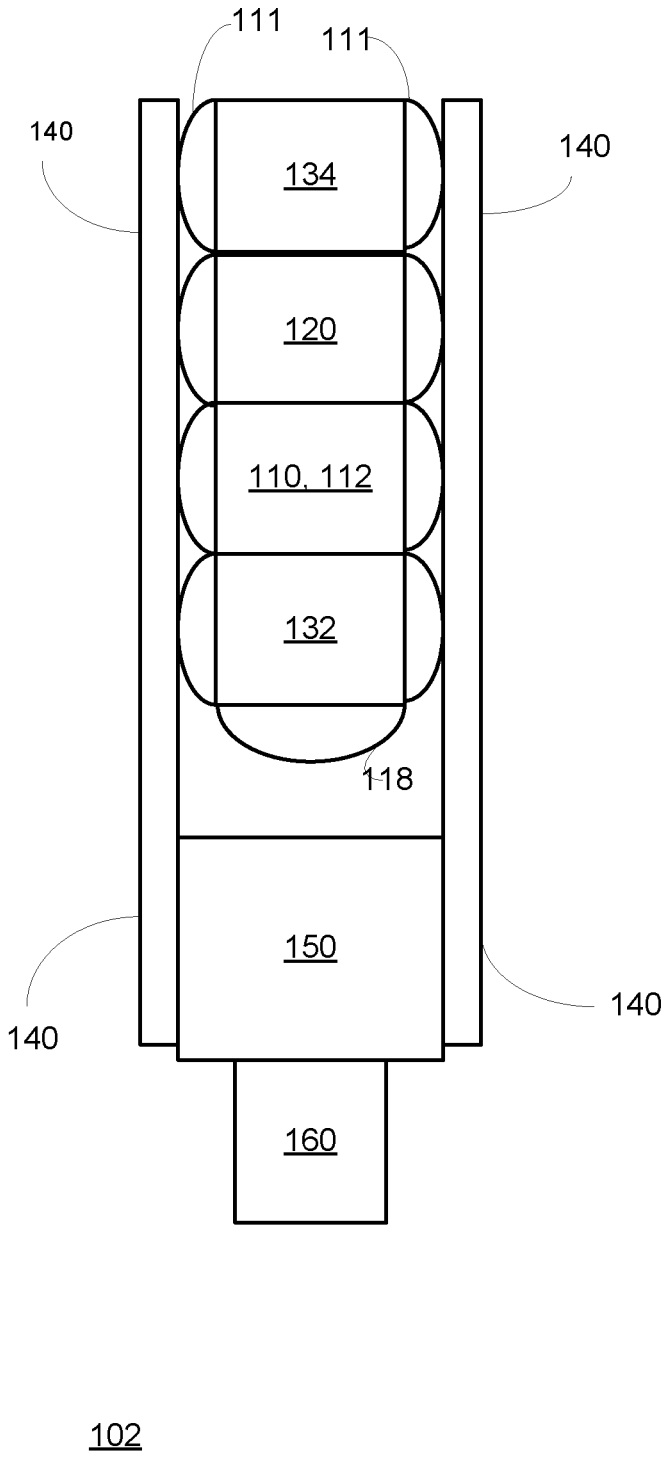
FIG. 5 illustrates a portion of a drilling system according to an embodiment of the invention.

FIGS. 4 and 5 illustrate portions 101 and 102 of a drilling system 100 according to an embodiment of the invention.

FIG. 4 illustrates the portion 101 as including:

a. A telemetry system 130 that is illustrated as having two telemetry modules 132 and 134.
b. A rechargeable battery 110. It is noted that multiple rechargeable batteries can be provided.
c. A battery identification module 112 that may be a part of the rechargeable battery 110 of be coupled to rechargeable battery 110.
d. A controller 120.

The rechargeable battery 110, battery identification module 112 and controller 120 are included in a rechargeable power module 170.

The rechargeable battery 110 supplied power to the telemetry system 130. It may provide power to each of the telemetry modules 132 and 134.

The controller 120 may receive battery information from the battery identification module 112 and, additionally or alternatively, from sensors (collectively denoted 118) such as temperature sensors, accelerators, pressure sensors and the like, and control the provision of power by the rechargeable battery 110. For example, if the temperature sensed by sensor 118 exceeds an allowable value the controller 120 can shut down the rechargeable battery 110.

Either one or elements 134,132,120, 110 and 112 can be connected to the drilling pipe 140, be connected to each other or be connected via an intermediate element (such as mechanical holders) to the drilling pipe 140. FIG. 5 illustrates spacers 111 that are connected between each of the elements and the drilling pipe 140. FIG. 5 also illustrates a bull nose plug 38 of the telemetry module 132.

FIG. 5 illustrates portion 102 according to an embodiment of the invention. FIG. 5 illustrates the telemetry modules 132 and 134, the controller 120, the rechargeable battery 110 and the battery identification module 112 as being placed within an inner space of a drilling pipe 140. It is noted that the drilling pipe can be partitioned to include multiple inner spaces and that different elements out of 110, 112, 120, 130, 132 and 134 can be positioned in different inner spaces of the drilling pipe 140.

FIG. 5 also illustrates the drilling pipe 140 as partially surrounding (or other wise in mechanical communication with) a drilling motor 150 and a drilling bit 160.

The telemetry system 130 may positioned as close to the drilling bit 160 as possible—but this is not necessarily so. The distance between the telemetry system 130 (or at least the telemetry module that is closest to the drilling bit) and the drilling bit 160 can be 15-30 meters, depending on the length of additional pieces of drilling pipe 140 and the length of the drilling motor 150.

It is noted that the number of telemetry system modules can differ then two, that there can be one or more rechargeable batteries, controllers and the like. The spatial relationships between these components can differ from those illustrated in FIG. 5.

Figure 6:
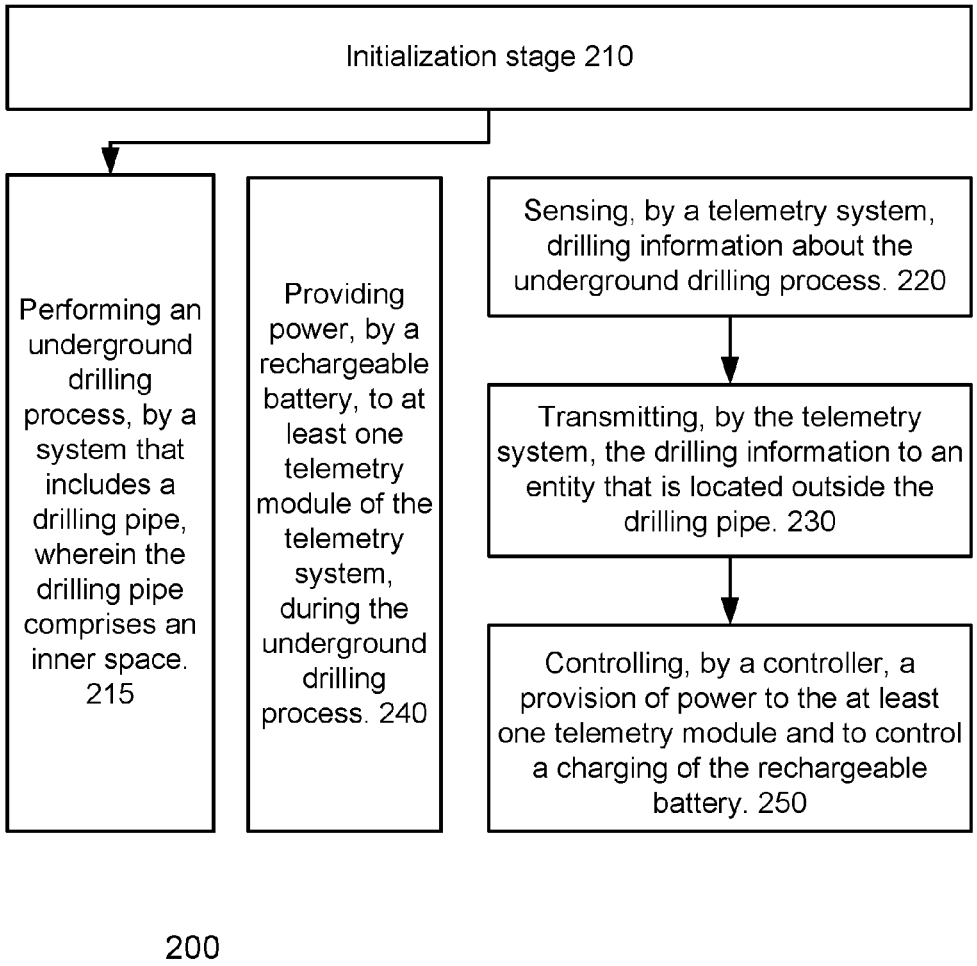
FIG. 6 illustrates a method according to an embodiment of the invention.

FIG. 6 illustrates a method 200 according to an embodiment of the invention. Method 200 can be executed by any of the systems illustrated in this specification.

Method 200 may start by initialization stage 210.

Stage 210 may include at least one of the following:

a. Recharging a rechargeable battery of a drilling system. The recharging can be executed under a control of a controller of the drilling system. The recharging can be dependent upon the conditions (such as temperature) of the borehole—especially if downhole recharging is attempted. For example—it the borehole temperature is outside an allowed range then the recharging can be allwoe—else it should be prevented.

b. Determining, by the controller, whether the rechargeable battery can be used to provide power to a telemetry system of the drilling system. The determination be responsive to rechargeable battery information such as an expiration date.

Stage 210 may be followed by stage 215 of performing an underground drilling process, by a system that comprises a drilling pipe, wherein the drilling pipe comprises an inner space. While stage 215 is executed, other stages of method 200, such as stages 220, 230, 240 and 250 can be executed.

Stage 220 includes sensing, by a telemetry system, drilling information about the underground drilling process.

Stage 230 includes transmitting, by the telemetry system, the drilling information to an entity that is located outside the drilling pipe.

Stage 240 includes providing power, by a rechargeable battery, to at least one telemetry module of the telemetry system, during the underground drilling process.

Stage 250 includes controlling, by a controller, a provision of power to the at least one telemetry module and to control a charging of the rechargeable battery.

Figure 2:
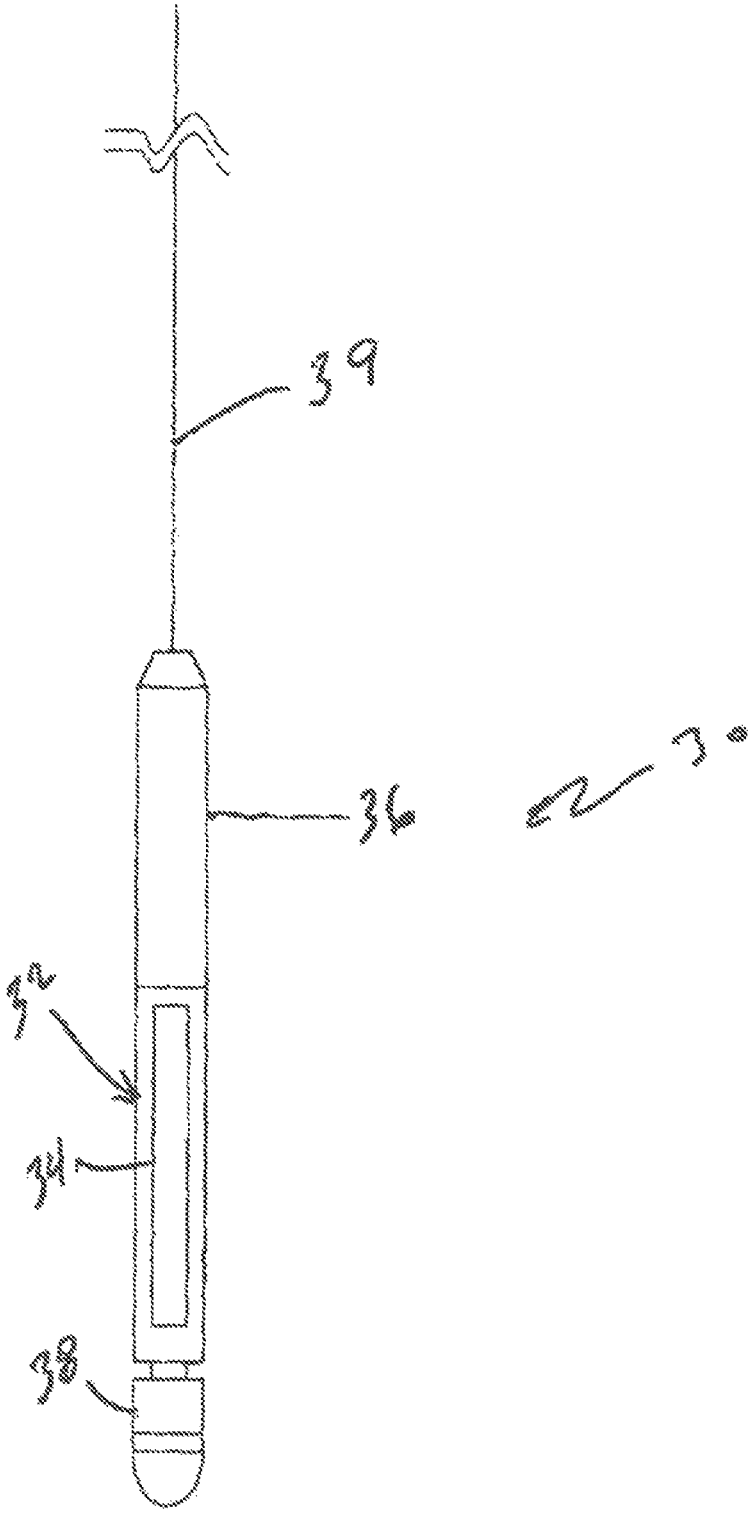
FIG. 2 is a schematic diagram showing the short hop receiver assembly of the electric dipole transmission system of the present invention.
Figure 3:
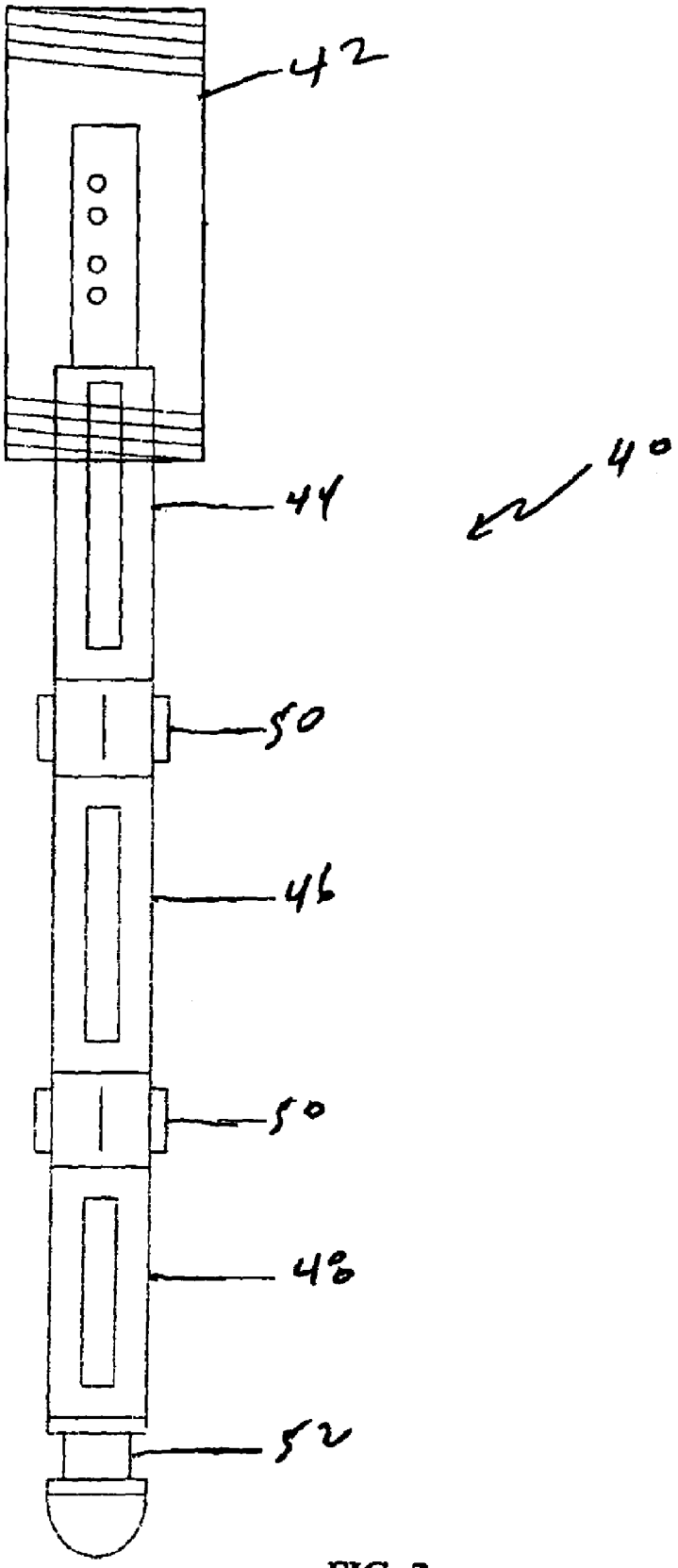
FIG. 3 is a schematic diagram showing the downhole assembly of the electric dipole transmission system of the present invention.

FIGS. 1-3 illustrate a drilling system that is an electric dipole transmission system according to various embodiments of the invention.

The electric dipole transmission system includes (a) an uphole dipole assembly (denoted 10 in FIG. 1), (b) a short hop receiver assembly (denoted 30 in FIG. 2), and (c) a downhole dipole assembly (denoted 40 in FIG. 3).

Each of these three assemblies (10, 30 and 40) may include a rechargeable power module such as the rechargeable power module that was denoted 170 in FIG. 4. The rechargeable power module of the uphole dipole assembly is denoted 14 in FIG. 1. The rechargeable power module of the downhole dipole assembly is denoted 46 in FIG. 3. According to an embodiment of the invention one assembly may power another assembly. For example—the short hop receiver assembly 30 may be powered by the rechargeable power module 14 of the uphole dipole assembly 10.

Each of these three assemblies may include one or more telemetry modules. The telemetry modules of the uphole dipole assembly 10 include electric dipole transmitter 12 and wireline receiver 16. The telemetry module of the short hop receiver assembly 30 is a short hop receiver 34. The telemetry modules of the downhole dipole assembly 40 include a short hop transmitter 44 and a sensor assembly 48.

The uphole dipole assembly 10 is adapted for receiving downhole telemetry data, the uphole dipole assembly 10 includes a gap sub, an electric dipole transmitter, a rechargeable battery module and a wireline receiver. A short hop receiver assembly is connected to the lower end of the uphole dipole assembly by a wireline. A downhole dipole assembly operatively connected to the uphole dipole assembly includes a short hop transmitter, a rechargeable battery module and a sensor assembly.

Referring first to FIG. 1, the uphole electric dipole assembly is generally identified by the reference numeral 10. The uphole dipole assembly 10 is mounted high in the bore hole and is typically positioned above any high or low resistivity formation strata that may block the transmission of downhole data to surface detection equipment.

The uphole electric dipole assembly 10 includes a gap sub 11, an electric dipole transmitter 12, a rechargeable battery module 14, and a wireline receiver 16. The uphole assembly components are provided with pin and box ends or the like for connection in vertical alignment. A rope socket 20 is connected to the lower end of the wireline receiver 16.

Referring now to FIG. 2, the short hop receiver assembly 30 of the invention is shown.

The short hop receiver assembly 30 includes a substantially elongate cylindrical body 32 housing a weight bar (not shown in the drawings) and a short hop receiver 34. A rope socket 36 is connected to the upper end of the short hop receiver body 32 and a bull nose plug 38 or the like is connected to the lower end of the short hop receiver body 32. The short hop receiver assembly 30 is connected to the uphole dipole assembly 10 by a wireline 39. The upper and lower ends of the wireline 39 include a cable head interface that enables it to be connected to the rope sockets 20 and 36 connected to the uphole dipole assembly 10 and short hop receiver assembly 30, respectively. The short hop receiver 34 is powered through the wireline 39 by battery 14 housed in the uphole dipole assembly 10.

Referring now to FIG. 3, the downhole assembly 40 of the present invention is bolted or otherwise secured to a nonmagnetic drill collar 42. The downhole assembly 40 includes a short hop transmitter 44, a rechargeable battery module 46 and a sensor assembly 48. The sensor assembly 48 houses one or more sensors for measuring borehole conditions near the drill bit, such as temperature, pressure, directional, and gamma sensors and the like. The downhole assembly 40 components are provided with pin and box ends or the like for connection in vertical alignment. The lower end of the downhole assembly 40 is capped with a bull nose plug 52 or the like. Centralizers 50 incorporated in the dipole assemblies 10 and 40 center the dipole assemblies within the drill string.

During drilling, telemetry data from sensors housed in the sensor assembly 48 is electrically transmitted to the short hop transmitter 44, which encodes the data and broadcasts it to the short hop receiver 34. A minimum separation distance between the short hop transmitter 44 and short hop receiver 34 is achieved by lowering the short hop receiver assembly 30 on the wireline 39 until the bull nose connector 38 mechanically locks with the upper end of the downhole dipole assembly 40. Upon receipt of data transmissions from the short hop transmitter 44, the short hop receiver 34 retransmits the data through the wireline 39 to the uphole wireline receiver 16.

It will be observed that when short hop receiver 34 and short hop transmitter 44 are locked together, the transmitting and receiving antennas thereof are in close proximity to each other. This enables reliable transmission of data transmissions in the presence of a high vibration drilling environment. In addition, the close proximity of the two antennae enables reliable transmission inside the magnetic well casing which strongly attenuates the transmitted signal for widely spaced antennae. Data received uphole by the wireline receiver 16 is logged to memory and then transmitted to surface equipment by applying low frequency phase modulated voltages across the gap sub 11.

On the surface, an auxiliary unit (such as communication unit located outside the drilling pipe) and especially receiving antenna 99 of FIG. 1 may detect the electric signal generated by the currents induced in the formation by the electrical voltages impressed across the gap sub 11. For further processing and display, surface signal-conditioning electronics filter and amplify the received signal before transmitting it to a surface computer.

While a preferred embodiment of the invention has been shown and described, other and further embodiments of the invention may be devised without departing from the basic scope thereof, and the scope thereof is determined by the claims which follow.

We claim:

1. A system, comprising: a drilling pipe that has an inner space; a telemetry system, arranged to: sense drilling information about an underground drilling process that is executed by the system; and transmit the drilling information to an entity that is located outside the drilling pipe; a rechargeable battery arranged to provide power to at least one telemetry module of the telemetry system; a controller, arranged to control a provision of power to the at least one telemetry module and to control a charging of the rechargeable battery; wherein the at least one telemetry module, the rechargeable battery and the controller are shaped and sized to be positioned within the inner space of the drilling pipe; and a battery identification module that is arranged to store rechargeable battery information, the rechargeable battery information comprises rechargeable battery identification information and at least zero information items out of a manufacturing date of the rechargeable battery, an expiration date of the rechargeable battery, allowed temperature of the rechargeable battery.

2. The system according to claim 1 wherein the controller is arranged to retrieve rechargeable battery information from the battery identification module and to control at least one operational parameter of the rechargeable battery in response to the rechargeable battery information.

3. A system, comprising: a drilling pipe that has an inner space; a telemetry system, arranged to: sense drilling information about an underground drilling process that is executed by the system; and transmit the drilling information to an entity that is located outside the drilling pipe; a rechargeable battery arranged to provide power to at least one telemetry module of the telemetry system; a controller, arranged to control a provision of power to the at least one telemetry module and to control a charging of the rechargeable battery; wherein the at least one telemetry module, the rechargeable battery and the controller are shaped and sized to be positioned within the inner space of the drilling pipe; and multiple rechargeable power modules, each rechargeable power module comprises a rechargeable battery and a controller.

4. The system according to claim 3, comprising an uphole electric dipole assembly, a short hop receiver assembly and a downhole assembly, each assembly of the uphole electric dipole assembly, the short hop receiver assembly and the downhole assembly comprises a rechargeable power module.

5. A method, comprising: performing an underground drilling process, by a system that comprises a drilling pipe, wherein the drilling pipe comprises an inner space; sensing, by a telemetry system, drilling information about the underground drilling process; transmitting, by the telemetry system, the drilling information to an entity that is located outside the drilling pipe; providing power, by a rechargeable battery, to at least one telemetry module of the telemetry system, during the underground drilling process; controlling, by a controller, a provision of power to the at least one telemetry module and to control a charging of the rechargeable battery; wherein the at least one telemetry module, the rechargeable battery and the controller are shaped and sized to be positioned within the inner space of the drilling pipe; and storing, by a battery identification module, rechargeable battery information, the rechargeable battery information comprises rechargeable battery identification information and at least zero information items out of a manufacturing date of the rechargeable battery, an expiration date of the rechargeable battery, allowed temperature of the rechargeable battery.

6. The method according to claim 5, comprising retrieving, by the controller, rechargeable battery information from the battery identification module and to controlling at least one operational parameter of the rechargeable battery in response to the rechargeable battery information.

7. The method according to claim 5, wherein the system comprises multiple rechargeable power modules, each rechargeable power module comprises a rechargeable battery and a controller.

8. The method according to claim 7, wherein the system comprises an uphole electric dipole assembly, a short hop receiver assembly and a downhole assembly, each assembly of the uphole electric dipole assembly, the short hop receiver assembly and the downhole assembly comprises a rechargeable power module.

9. The method according to claim 8, wherein the uphole electric dipole assembly further comprises a gap sub, a rechargeable battery module and a wireline receiver operatively connected; wherein the short hop receiver assembly further comprises a weight bar and a short hop receiver; and wherein the downhole assembly is mounted on a nonmagnetic drill collar, the downhole assembly further comprises a short hop transmitter, and a sensor assembly operatively connected; wherein the system further comprises wireline having an upper end connected to the uphole dipole assembly and a lower end connected to the short hop receiver assembly.

* * * * *